US008328510B2

(12) United States Patent
Nakaniwa et al.

(10) Patent No.: US 8,328,510 B2
(45) Date of Patent: Dec. 11, 2012

(54) SEALING DEVICE FOR ROTARY FLUID MACHINE, AND ROTARY FLUID MACHINE

(75) Inventors: Akihiro Nakaniwa, Takasago (JP); Jo Masutani, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 582 days.

(21) Appl. No.: 12/528,509

(22) PCT Filed: May 26, 2008

(86) PCT No.: PCT/JP2008/059636

§ 371 (c)(1),
(2), (4) Date: Aug. 25, 2009

(87) PCT Pub. No.: WO2008/149704

PCT Pub. Date: Dec. 11, 2008

(65) Prior Publication Data

US 2010/0028148 A1 Feb. 4, 2010

(30) Foreign Application Priority Data

Jun. 6, 2007 (JP) ..... 2007-150677

(51) Int. Cl.
*F04D 29/10* (2006.01)

(52) U.S. Cl. ..... 415/208.1; 415/230

(58) Field of Classification Search ..... 415/111–113, 415/144, 145, 170.1, 171.1, 172.1, 173.5, 415/173.6, 174.5, 185, 191, 192, 229, 230; 277/413, 415–421

See application file for complete search history.

(56) References Cited

U.S. PATENT DOCUMENTS 4,248,566 A * 2/1981 Chapman et al. ..... 415/26
4,938,661 A * 7/1990 Kobayashi et al. ..... 415/199.1
5,161,943 A * 11/1992 Maier et al. ..... 415/170.1

(Continued)

FOREIGN PATENT DOCUMENTS

JP 56-107997 8/1981

(Continued)

OTHER PUBLICATIONS

International Search Report dated Aug. 26, 2008 for International Application No. PCT/JP2008/059636.

*Primary Examiner* — Edward Look
*Assistant Examiner* — Christopher R Legendre
(74) *Attorney, Agent, or Firm* — Wenderoth, Lind & Ponack, L.L.P.

(57) ABSTRACT

A sealing device includes a housing that rotatably accommodates a rotary shaft, a plurality of guide parts that extend along at least one of a radial direction and an axial direction of the rotary shaft and that impart flow velocity components in the rotation direction of the rotary shaft to fluid passing through therebetween, a partition part that connects ends of the plurality of guide parts and that serves as a partition between spaces between the plurality of guide parts and an outside space, a first seal part that is an annular protrusion extending in the radial direction, that forms a first gap with respect to the rotary shaft or the housing, and that blocks fluid flowing toward the plurality of guide parts, and a second seal part that is an annular protrusion, that forms a second gap with respect to the rotary shaft or the partition part, and that blocks fluid flowing through the outside space.

8 Claims, 8 Drawing Sheets

U.S. PATENT DOCUMENTS

| | | | | |
|---|---|---|---|---|
| 5,236,301 | A * | 8/1993 | Palmer | 415/116 |
| 5,277,541 | A * | 1/1994 | Palmer | 415/58.2 |
| 6,435,822 | B1 * | 8/2002 | Kobayashi et al. | 415/172.1 |
| 6,959,929 | B2 * | 11/2005 | Pugnet et al. | 277/408 |
| 2010/0028148 | A1 * | 2/2010 | Nakaniwa et al. | 415/230 |
| 2010/0119367 | A1 * | 5/2010 | Nakaniwa | 415/230 |

FOREIGN PATENT DOCUMENTS

| | | |
|---|---|---|
| JP | 58-22444 | 5/1983 |
| JP | 59-226299 | 12/1984 |
| JP | 2756118 | 7/1989 |
| JP | 5-296190 | 11/1993 |
| JP | 2002-22033 | 1/2002 |

* cited by examiner

SEALING DEVICE FOR ROTARY FLUID MACHINE, AND ROTARY FLUID MACHINE

BACKGROUND OF THE INVENTION

I. Technical Field

The present invention relates to sealing devices for rotary fluid machines that are preferably applied to rotary fluid machines such as multistage compressors and relates to rotary fluid machines.

II. Description of the Related Art

It is known that, in rotary fluid machines such as multistage centrifugal compressors, the occurrence of swirling stall causes vibration of a rotary shaft (shaft vibration), and the point of occurrence of the shaft vibration is the compressor operating limit.

A known method of preventing swirling stall is a method involving reducing the area of a flow passage of a vaneless portion, in other words, a method of reducing the height of the flow passage in the rotational axis direction. In this way, the flow velocity components outward in the radial direction speed up in the vaneless portion to prevent the flow separation at an impeller outlet port, thereby suppressing the occurrence of swirling stall.

However, when the area of the flow passage of the vaneless portion is reduced, there is a problem in that the loss occurring in the vaneless portion increases, reducing the efficiency of the compressor.

On the other hand, in multistage centrifugal compressors, an interstage labyrinth is disposed to prevent fluid leakage between stages (see Japanese Examined Utility Model Application, Publication No. SHO-58-022444 and Publication of Japanese Patent No. 2756118, for example).

It is also known that a flow of fluid leaking from a rear stage to a front stage via the interstage labyrinth functions to suppress the above-mentioned swirling stall. Specifically, the above-mentioned leakage flow forms a circulation flow that flows through the rear stage, the interstage labyrinth, and the diffuser of the front stage in this order, and the circulation flow increases the velocity of radially-outward flow components of a fluid flow flowing in the diffuser. Therefore, flow separation at the impeller outlet port is prevented, and the occurrence of swirling stall is suppressed.

In the method of preventing swirling stall by the interstage labyrinth described in Japanese Examined Utility Model Application, Publication No. SHO-58-022444 and Publication of Japanese Patent No. 2756118, however, there is a problem in that the compressor efficiency is reduced.

Specifically, in order to prevent swirling stall, radially-outward flow components of the fluid flow flowing in the diffuser need to have a certain velocity or more. To obtain this flow velocity, a clearance of the interstage labyrinth needs to be increased. When the clearance is thus increased, swirling stall can be prevented, but the flow rate of a fluid flow leaking from the rear stage to the front stage is increased, leading to a problem in that the compressor efficiency is reduced.

Further, the leakage flow passing through the clearance of the interstage labyrinth does not include flow velocity components in the circumferential direction of the rotary shaft, and, when the leakage flow flows behind the impeller, flow velocity components in the circumferential direction are imparted to the leakage flow by the rotation of the impeller. In other words, the impeller performs extra work for imparting flow velocity components in the circumferential direction to the leakage flow, thereby causing a problem in that the compressor efficiency is reduced.

Furthermore, there is a problem in that, when a fluid flow flowing into the diffuser from the impeller outlet port and a fluid flow flowing into the diffuser from behind the impeller are joined, loss occurs because of the difference in flow velocity of circumferential flow velocity components, thereby reducing the compressor efficiency.

The present invention has been made to solve the above-described problems, and an object thereof is to provide a sealing device for a rotary fluid machine and a rotary fluid machine capable of reducing a decrease in efficiency and suppressing swirling stall in a multistage rotary fluid machine.

In order to achieve the above-described object, the present invention provides the following solutions.

According to a first aspect, the present invention provides a sealing device for a rotary fluid machine, including: a housing that rotatably accommodates a rotary shaft having a plurality of impellers; a plurality of guide parts that are mounted on an inner surface of the housing, between the plurality of impellers, that extend along at least one of a radial direction and an axial direction of the rotary shaft, and that impart flow velocity components in the rotation direction of the rotary shaft to fluid passing through therebetween; a partition part that connects other ends of the plurality of guide parts opposite to ends thereof mounted on the housing and that serves as a partition between spaces between the plurality of guide parts and an outside space; a first seal part that is an annular protrusion extending in the radial direction, that forms a first gap with respect to the rotary shaft or the housing, and that blocks fluid flowing toward the plurality of guide parts; and a second seal part that is an annular protrusion, that forms a second gap with respect to the rotary shaft or the partition part, and that blocks fluid flowing through the outside space.

According to the first aspect of the present invention, since a route is formed in which fluid circulates from the rear-stage-side impeller to the front-stage-side impeller via the first gap and the spaces between the plurality of guide parts or the second gap, the occurrence of swirling stall in the rotary fluid machine can be prevented.

Further, most of the fluid flowing from the rear-stage-side impeller toward the plurality of guide parts through the first gap flows through spaces between the plurality of guide parts, which spaces are defined by the plurality of guide parts, the housing, and the partition part, and the rest of the fluid flows through the second gap. Since the plurality of guide parts impart flow velocity components in the rotation direction of the rotary shaft to the fluid passing through therebetween, it is possible to prevent a decrease in efficiency in the rotary fluid machine.

In the first aspect of the invention, it is preferable to have a structure in which the other ends of the plurality of guide parts face the impeller extending from the rotary shaft outward in the radial direction; and the partition part extends in the radial direction, is formed in a ring-plate-like shape to connect the other ends, and makes the fluid pass inward in the radial direction through the spaces between the plurality of guide parts.

By doing so, when fluid flowing through the spaces between the plurality of guide parts is directed inward along the radial direction, the length of the sealing device along the axial direction can be reduced. Further, it is possible to reduce the axial length of the multistage rotary fluid machine in which the sealing device of the invention is provided.

Further, it is possible to increase the lengths of the guide parts in the direction along the flow of fluid, that is, the lengths thereof in the radial direction, without changing the length of the sealing device along the axial direction. Therefore, the flow velocity components in the radial direction can be imparted more reliably to the fluid while the fluid flows between the plurality of guide parts.

In the first aspect of the invention, it is preferable that the other ends of the plurality of guide parts face an outer circumferential surface of the rotary shaft; and the partition part extend in the axial direction, be formed in a cylindrical shape to connect the other ends, and make the fluid pass along the axial direction through the spaces between the plurality of guide parts.

By doing so, the fluid flowing through the spaces between the plurality of guide parts is directed from the first seal part toward the plurality of guide parts along the axial direction, thereby making it possible to reduce the length of the sealing device along the radial direction.

In the above-described structure, it is preferable that the second seal part be an annular protrusion extending in the radial direction; and a step part that radially expands the outer circumferential surface of the rotary shaft be provided at a location of the rotary shaft facing the first seal part or the second seal part.

By doing so, the step part, which radially expands the outer circumferential surface of the rotary shaft, is provided at a location facing the first seal part or the second seal part, thereby making it possible to change the relative position of the first gap and the second gap in the radial direction. Therefore, fluid that has passed through the first gap is prevented from directly flowing into the second gap, and the sealing performance of the sealing device can be improved.

In the first aspect of the invention, it is preferable that the guide parts be plate-like members inclining in the rotation direction of the rotary shaft outward in the radial direction, or be plate-like members inclining in the rotation direction of the rotary shaft from the first seal part toward the second seal part.

By doing so, the guide parts are formed in a plate-like shape, which is simpler than the shape of blade-like guide parts, for example, and therefore the sealing device is easily manufactured.

In the first aspect of the invention, it is preferable that the guide parts be blade-like members extending along the radial direction or the axial direction and be curved in the rotation direction of the rotary shaft outward in the radial direction, or be curved in the rotation direction of the rotary shaft from the first seal part toward the second seal part.

By doing so, the guide parts are formed in a blade-like shape and are curved in the rotation direction of the rotary shaft, thereby making it possible to effectively impart flow velocity components in the rotation direction of the rotary shaft to the fluid passing through the plurality of guide parts, compared with a case where the guide parts are formed in a plate-like shape.

According to a second aspect, the present invention provides a rotary fluid machine including the sealing device according to the first aspect of the present invention.

According to the second aspect of the present invention, since the sealing device according to the first aspect of the present invention is provided, it is possible to allow fluid to flow from the rear-stage-side impeller toward the front-stage-side impeller via the sealing device and to prevent the occurrence of swirling stall in the rotary fluid machine.

It is possible to impart flow velocity components in the rotation direction of the rotary shaft to fluid flowing through the sealing device from the rear-stage-side impeller toward the front-stage-side impeller and to prevent a decrease in efficiency in the rotary fluid machine.

According to the sealing device for a rotary fluid machine of the first aspect of the present invention and the rotary fluid machine of the second aspect thereof, since a route is formed in which fluid circulates from the rear-stage-side impeller to the front-stage-side impeller via the first gap and the spaces between the plurality of guide parts or the second gap, an advantage is afforded in that the occurrence of swirling stall in the rotary fluid machine can be prevented.

Further, since the plurality of guide parts impart flow velocity components in the rotation direction of the rotary shaft to fluid passing through therebetween, an advantage is afforded in that it is possible to prevent a decrease in efficiency in the rotary fluid machine.

FIRST EMBODIMENT

A compressor according to a first embodiment of the present invention will be described below with reference to FIGS. 1 to 4.

Figure 1:
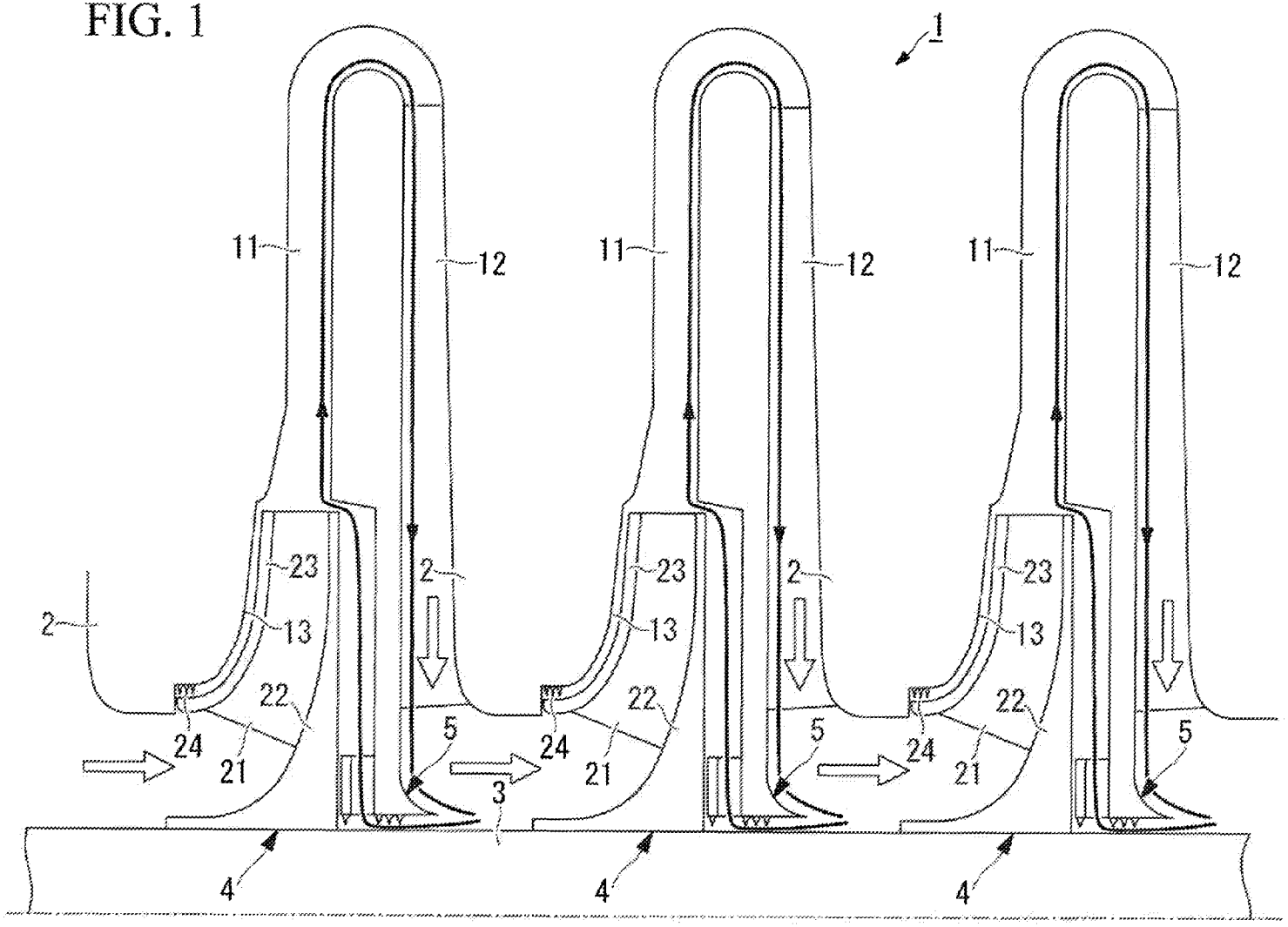
FIG. 1 is a schematic view explaining the structure of a compressor according to a first embodiment of the present invention.

FIG. 1 is a schematic view for explaining the structure of the compressor according to this embodiment.

A compressor (rotary fluid machine) 1 is supplied with a rotary driving force from an external power source, such as a motor, to supply high-pressure gas. In this embodiment, a description will be given of a multistage compressor of the present invention.

As shown in FIG. 1, the compressor 1 includes a housing 2, a rotary shaft 3, a plurality of impellers 4, and a sealing device 5.

The housing 2 rotatably holds the rotary shaft 3 and the plurality of impellers 4 therein and includes the sealing device 5 on an inner surface thereof between the impellers 4. Further, the housing 2 includes a diffuser 11 that supplies high-pressure gas generated by a front-stage impeller 4 to a rear-stage impeller 4, and an impeller chamber 13 in which each impeller 4 is rotatably disposed.

The diffuser 11 converts part of dynamic pressure of gas blown out by the front-stage impeller 4 outward in the radial direction into static pressure to increase the pressure thereof and guides the gas to a return vane 12.

The return vane 12 is a flow passage whose extending direction changes to radially inward, to extend to a center portion of the rear-stage impeller 4.

The impeller chamber 13 is a space formed between a plurality of return vanes 12 to be a substantially similar figure to the impeller 4 disposed therein. A through-hole through which the rotary shaft 3 passes is formed at a location in the impeller chamber 13 that faces a disc 22, and the sealing device 5 is disposed in the through-hole.

The rotary shaft 3 transmits externally-supplied rotary driving force to each impeller 4.

As shown in FIG. 1, the impeller 4, which extends outward in the radial direction, is provided at the center portion of the rotary shaft 3.

The impeller 4 is rotationally driven by the externally-supplied rotary driving force, and transmits its kinetic energy to the gas to increase the pressure of the gas.

The impeller 4 includes a plurality of rotary vanes 21, the disc 22, and a shroud 23.

The rotary vanes 21 are rotationally driven to impart energy to the gas flowing in between the rotary vanes 21, thereby generating higher-pressure gas.

The rotary vanes 21 are disposed between the disc 22 and the shroud 23 at equal intervals in the circumferential direction of the rotary shaft 3 and extend in the axial direction.

The disc 22 is a disc-like member extending from the rotary shaft 3 outward in the radial direction and is formed to have a smoothly-curved surface that faces the shroud 23 and that approaches the shroud 23 toward the rotary shaft 3. On the other hand, a rear surface (surface at the right side in FIG. 1) of the disc 22 is formed to be substantially perpendicular to the rotary shaft 3, and a gap through which a disc-back flow flows is formed between the rear surface of the disc 22 and the impeller chamber 13.

The shroud 23 is a ring-plate-like member that is located close to the front-stage impeller 4 and oppositely to the disc 22 and that extends along the radial direction of the rotary shaft 3, and is formed to have a curved surface approaching the front-stage impeller 4 toward the rotary shaft 3. A shroud-side seal part 24 that blocks a leakage flow flowing between the shroud 23 and the impeller chamber 13 is provided on a surface of the impeller chamber 13 that faces the shroud 23, in an area adjacent to the front-stage impeller 4.

The shroud-side seal part 24 is annular protrusions extending from the impeller chamber 13 toward the shroud 23 to form a labyrinth seal.

The sealing device 5 blocks a gas flow leaking from the rear-stage impeller 4 toward the front-stage impeller 4 via the space between the housing 2 and the rotary shaft 3 and imparts flow velocity components in the circumferential direction of the rotary shaft 3 to this leakage flow.

The sealing device 5 includes a plurality of guide plates (guide parts) 31, a partition plate (partition part) 32, a first seal part 34, and a second seal part 33.

Figure 2:
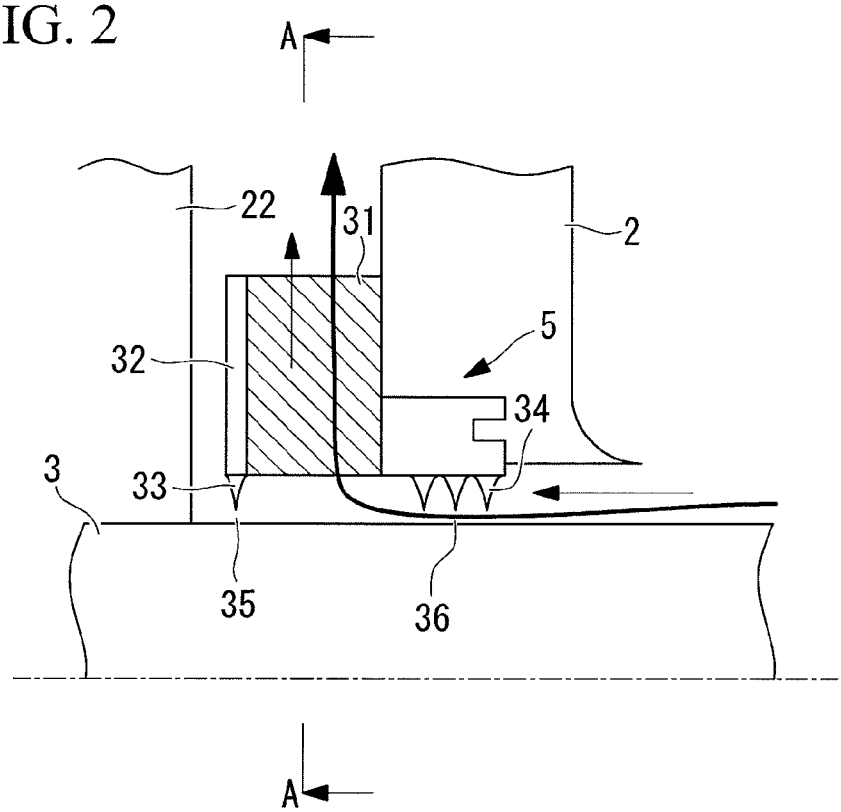
FIG. 2 is a schematic view explaining the structure of a sealing device shown in FIG. 1.
Figure 3:
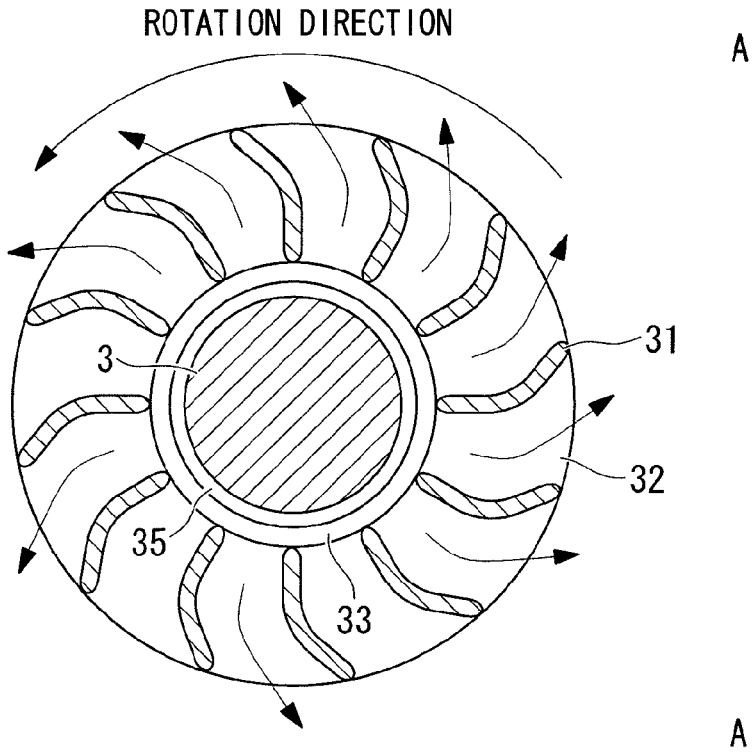
FIG. 3 is a cross-sectional view explaining the structure of guide plates shown in FIG. 2 along the line A-A.

FIG. 2 is a schematic view for explaining the structure of the sealing device shown in FIG. 1. FIG. 3 is a cross-sectional view for explaining the structure of the guide plates shown in FIG. 2 along the line A-A.

The plurality of guide plates 31 are blade-like members used to impart circumferential flow-velocity components to a leakage flow passing through the sealing device 5.

As shown in FIGS. 1 to 3, on a surface of the impeller chamber 13 that faces the disc 22 and that is adjacent to the rotary shaft 3, the guide plates 31 extend along the axial direction of the rotary shaft 3 and are disposed at equal intervals in the circumferential direction. Further, towards the outer side in the radial direction, the guide plates 31 are disposed at an angle in a rotation direction of the rotary shaft 3.

The partition plate 32 is a ring-plate-like member serving as a partition between spaces between the plurality of guide plates 31 and a space between the disc 22 and the guide plates 31.

The partition plate 32, which is the ring-plate-like member extending in the radial direction, is disposed to connect ends of the plurality of guide plates 31 that are close to the disc 22.

The first seal part 34 blocks a gas flow flowing between the housing 2 and the rotary shaft 3 and prevents high-pressure gas from leaking from the inside of the compressor 1 to the outside.

The first seal part 34 is a plurality of annular protrusions extending from a surface of the housing 2 that faces the rotary shaft 3 toward the rotary shaft 3, in other words, extending inward in the radial direction, to form a labyrinth seal. A first gap 36 is formed between the first seal part 34 and the rotary shaft 3.

The second seal part 33 blocks a gas flow flowing between the disc 22 and the partition plate 32 and guides most of a gas flow flowing between the rotary shaft 3 and the first seal part 34 to the spaces surrounded by the plurality of guide plates 31, the partition plate 32, and the impeller chamber 13.

The second seal part 33 is an annular protrusion extending from an inner-circumferential end of the partition plate 32 toward the rotary shaft 3, in other words, extending inward in the radial direction, forming a second gap 35 with respect to the rotary shaft 3.

Next, generation of high-pressure gas in the compressor 1, having the above-described structure, will be described with reference to FIG. 1.

When the compressor 1 is externally supplied with rotary driving force, the impeller 4 is rotationally driven via the rotary shaft 3. When the impeller 4 is rotationally driven, gas flowing between the rotary vanes 21 is rotated together with the rotary vanes 21 and is blown outward in the radial direction by centrifugal force. On the other hand, gas blown out from the front-stage impeller 4 flows in between the rotary vanes 21.

The gas blown outward in the radial direction flows into the diffuser 11 and changes to higher-pressure gas after part of the dynamic pressure imparted by the impeller 4 is converted into static pressure. The high-pressure gas generated in this way is supplied to the rear-stage impeller 4 via the diffuser 11.

On the other hand, part of the high-pressure gas in the diffuser 11 flows in between the impeller chamber 13 and the shroud 23.

The high-pressure gas flowing in between the impeller chamber 13 and the shroud 23 flows toward an upstream side of the impeller because of the difference in pressure. This flow is blocked by the shroud-side seal part 24, and its flow rate is reduced.

Further, part of the high-pressure gas at an outlet port of the return vane flows in between the rotary shaft 3 and the housing 2 and then flows in between the impeller chamber 13 and the disc 22 via the sealing device 5. The gas flow flowing in between the impeller chamber 13 and the disc 22 flows outward in the radial direction and then flows into the diffuser 11 again. In other words, the flow circulates through the diffuser 11, the return vane 12, and the space between the impeller chamber 13 and the disc 22.

The sealing device 5 disposed between the rotary shaft 3 and the housing 2 blocks this circulation flow, reduces the flow rate thereof, and imparts circumferential flow velocity components thereto. The flow of leaking gas in the sealing device 5 will be described in detail below.

Next, the operation of the sealing device 5, which is a feature of this embodiment, will be described with reference to FIGS. 2 and 3.

As described above, since the gas flow flowing from the vicinity of the outlet port of the return vane 12 to between the rotary shaft 3 and the housing 2 toward the disc 22 does not include flow velocity components in the circumferential direction of the rotary shaft 3, the gas flow flows along the axial direction.

The gas flowing along the axial direction is blocked by the first seal part 34, which forms the labyrinth seal. Part of the gas flow blocked by the first seal part 34 passes through the first gap 36 between the first seal part 34 and the rotary shaft 3 and flows toward the disc 22.

Most of the gas flow flowing toward the disc 22 is directed, at a location where the guide plates 31 are provided, outward in the radial direction to flow into the spaces between the guide plates 31, the housing 2, and the partition plate 32. As shown in FIGS. 2 and 3, since the guide plates 31 are inclined in the rotation direction of the rotary shaft 3 towards the outer side in the radial direction, flow velocity components in the circumferential direction toward the rotation direction of the rotary shaft 3 are imparted to the gas flow flowing outward in the radial direction.

The second seal part 33 is disposed between the rotary shaft 3 and the partition plate 32, and a throttle is formed of the second gap 35 formed by the second seal part 33 and the rotary shaft 3. Therefore, only part of the gas flow flowing toward the disc 22 flows into a flow passage formed between the disc 22 and the partition plate 32, and most of the gas flow flows into flow passages formed between the guide plates 31.

Further, since the partition plate 32 is provided on the ends of the guide plates 31 that are close to the disc 22, the gas flow flowing toward the disc 22 neither flows from between the guide plates 31 to between the disc 22 and the partition plate 32 nor flows in reverse from between the disc 22 and the partition plate 32 to between the guide plates 31.

On the other hand, the gas flow that has passed through the second gap 35 joins the gas flow that has passed through between the guide plates 31. The joined gas flow flows through the gap between the disc 22 and the impeller chamber 13 outward in the radial direction to flow into the diffuser 11.

In this embodiment, a description is given of an example case where the second gap 35 is sufficiently narrow, and a flow blocking function of the second seal part 33 sufficiently works.

According to the above-described structure, since a route is formed in which fluid circulates from the rear-stage-side impeller 4 to the front-stage-side impeller 4 via the first gap 36 and the spaces between the plurality of guide plates 31 or the second gap 35, the occurrence of swirling stall in the compressor 1 can be prevented.

Further, most of the gas flowing from the rear-stage-side impeller 4 toward the plurality of guide plates 31 through the first gap 36 flows through the spaces between the plurality of guide plates 31, which spaces are defined by the plurality of guide plates 31, the housing 2, and the partition plate 32, and the rest of the gas flows through the second gap 35. Since the plurality of guide plates 31 impart flow velocity components in the rotation direction of the rotary shaft 3 to the gas passing through therebetween to reduce friction loss occurring between the gas and the disc, it is possible to prevent a decrease in efficiency in the compressor 1.

When the gas flowing through the spaces between the plurality of guide plates 31 is directed outward along the radial direction, the length of the sealing device 5 along the axial direction can be reduced. Further, it is possible to reduce the axial length of the multistage compressor 1 in which the sealing device 5 of this embodiment is provided.

Further, it is possible to increase the lengths of the guide plates 31 in the direction along the gas flow, that is, the lengths thereof in the radial direction, without changing the length of the sealing device 5 along the axial direction. Therefore, the flow velocity components in the radial direction can be imparted more reliably to the gas while the gas flows between the plurality of guide plates 31.

The guide plates 31 are formed in a blade-like shape and are curved in the rotation direction of the rotary shaft 3, thereby making it possible to effectively impart flow velocity components in the rotation direction of the rotary shaft 3 to the gas passing through the plurality of guide plates 31, compared with a case where the guide plates 31 are formed in a plate-like shape.

Since the sealing device 5 of this embodiment is provided, it is possible to allow gas to flow from the rear-stage-side impeller 4 toward the front-stage-side impeller 4 via the sealing device 5 and to prevent the occurrence of swirling stall in the compressor 1.

It is possible to impart flow velocity components in the rotation direction of the rotary shaft 3 to gas flowing through the sealing device 5 from the rear-stage-side impeller 4 toward the front-stage-side impeller 4 and to prevent a decrease in efficiency in the compressor 1.

Figure 4:
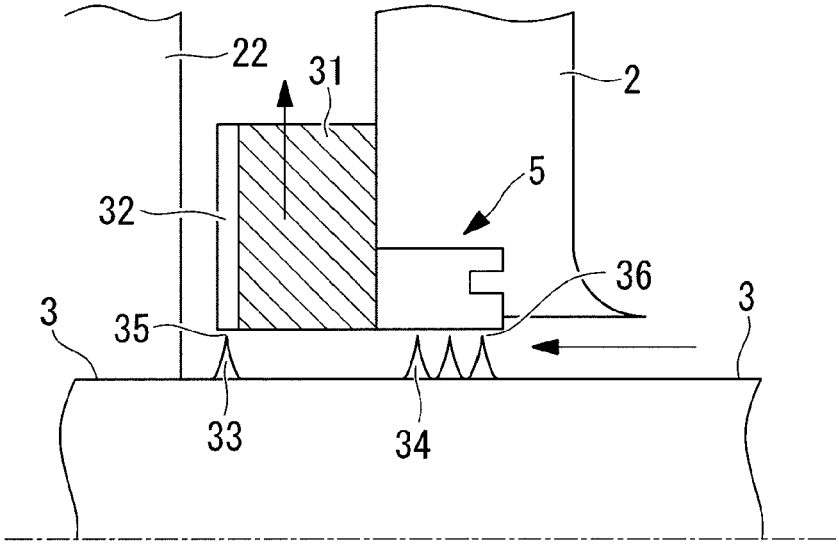
FIG. 4 is a schematic view explaining the sealing device shown in FIG. 2 according to another embodiment.

FIG. 4 is a schematic view for explaining the sealing device shown in FIG. 2 according to another embodiment.

Note that, as in the above-described embodiment, the first seal part 34 and the second seal part 33 may be annular protrusions extending inward in the radial direction to respectively form the first gap 36 and the second gap 35 with respect to the rotary shaft 3, or, as shown in FIG. 4, the first seal part 34 may be annular protrusions extending outward in the radial direction to form the first gap 36 between the first seal part 34 and the housing 2, and the second seal part 33 may be annular protrusions extending outward in the radial direction to form the second gap 35 between the second seal part 33 and the partition plate 32; their structures are not particularly limited.

First Modification of First Embodiment

Next, a first modification of the first embodiment of the present invention will be described with reference to FIGS. 5 and 6.

Although the basic structure of a compressor of this modification is the same as that of the first embodiment, the structure of a sealing device is different from that of the first embodiment. Therefore, in this modification, only the structure of the sealing device and components surrounding it will be described with reference to FIGS. 5 and 6, and a description of the other components will be omitted.

Figure 5:
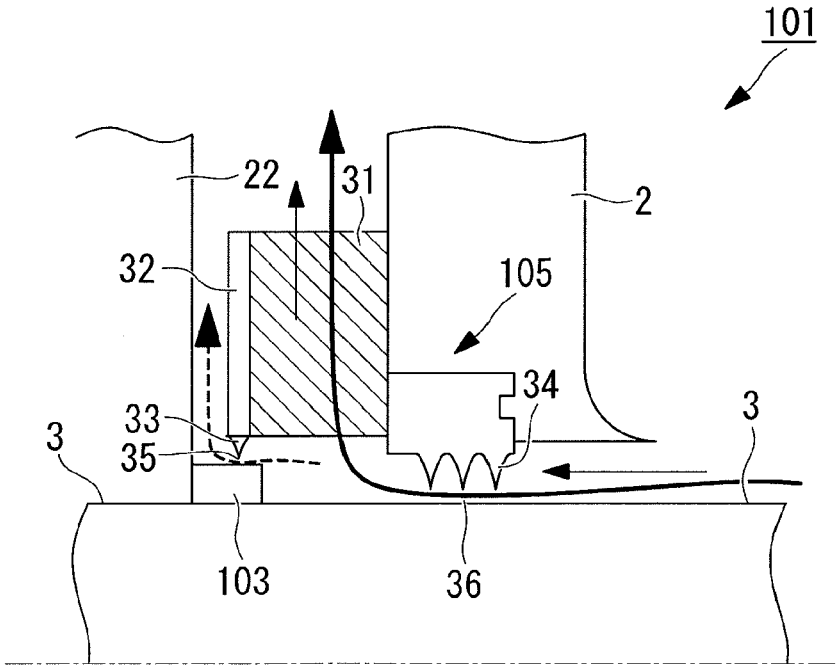
FIG. 5 is a schematic view explaining the structure of a sealing device in a compressor according to a first modification of the first embodiment of the present invention.

FIG. 5 is a schematic view for explaining the structure of the sealing device in the compressor according to this modification.

Note that identical reference numerals are given to the same components as those of the first embodiment, and a description thereof will be omitted.

As shown in FIG. 5, a sealing device 105 of a compressor (rotary fluid machine) 101 includes the plurality of guide plates 31, the partition plate 32, the first seal part 34, the second seal part 33, and a step part 103.

The step part 103 is a cylindrical member disposed on the outer circumferential surface of the rotary shaft 3 and is disposed adjacent to the disc 22 of the impeller 4.

The length of the step part 103 in the axial direction of the rotary shaft 3 is larger than the length of at least a gap between the disc 22 and the partition plate 32, and the thickness of the step part 103, in other words, the thickness from the inner circumferential surface to the outer circumferential surface of the step part 103, is larger than the length of the first gap 36.

Therefore, the second gap 35 is formed between the step part 103 and the second seal part 33. The second gap 35 formed in this modification is equal to or wider than the second gap 35 of the first embodiment. Further, the distance of the second gap 35 from the rotary shaft 3, that is, the position in the radial direction, is farther than that of the first gap 36. In other words, the second gap 35 is located farther radially outward.

Next, the operation of the sealing device 105, which is a feature of this modification, will be described with reference to FIG. 5. Note that since high-pressure gas is generated in the compressor 101 of this modification in the same way as in the first embodiment, a description thereof will be omitted.

Since a gas flow flows from the rear-stage-side impeller 4 toward the disc 22 through the first gap 36 in the same way as in the first embodiment, a description thereof will be omitted.

The gas flow that has passed through the first gap 36 flows along the axial direction of the rotary shaft 3, and most of the gas flow changes its direction outward in the radial direction to flow in between the guide plates 31.

The rest of the gas flow that has kept on flowing along the axial direction of the rotary shaft 3 is prevented from flowing into the second gap 35 when colliding against the step part 103.

Since the subsequent flow of the gas flowing between the guide plates 31 is the same as that in the first embodiment, a description thereof will be omitted.

According to the above-described structure, the step part 103, which radially expands the outer circumferential surface of the rotary shaft 3, is provided at a location facing the second seal part 33, thereby changing the relative position of the first gap 36 and the second gap 35 in the radial direction. Therefore, gas that has passed through the first gap 36 is prevented from directly flowing into the second gap 35, and the sealing performance of the sealing device 105 can be improved.

Figure 6:
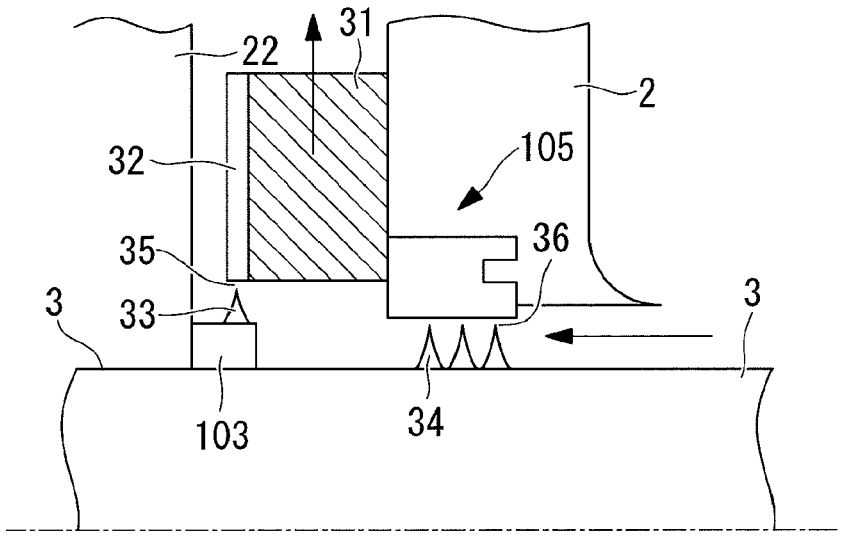
FIG. 6 is a schematic view explaining the sealing device shown in FIG. 5 according to another embodiment.

FIG. 6 is a schematic view for explaining the sealing device shown in FIG. 5 according to another embodiment.

Note that, as in the above-described modification, the first seal part 34 and the second seal part 33 may be annular protrusions extending inward in the radial direction to form the first gap 36 with respect to the rotary shaft 3 and to form the second gap 35 with respect to the step part 103, or, as shown in FIG. 6, the first seal part 34 and the second seal part 33 may be annular protrusions extending outward in the radial direction to form the first gap 36 between the first seal part 34 and the housing 2 and to form the second gap 35 between the second seal part 33 and the partition plate 32; their structures are not particularly limited.

Second Modification of First Embodiment

Next, a second modification of the first embodiment of the present invention will be described with reference to FIG. 7.

Although the basic structure of a compressor of this modification is the same as that of the first embodiment, the structure of a sealing device is different from that of the first embodiment. Therefore, in this modification, only the structure of the sealing device and components surrounding it will be described with reference to FIG. 7, and a description of the other components will be omitted.

Figure 7:
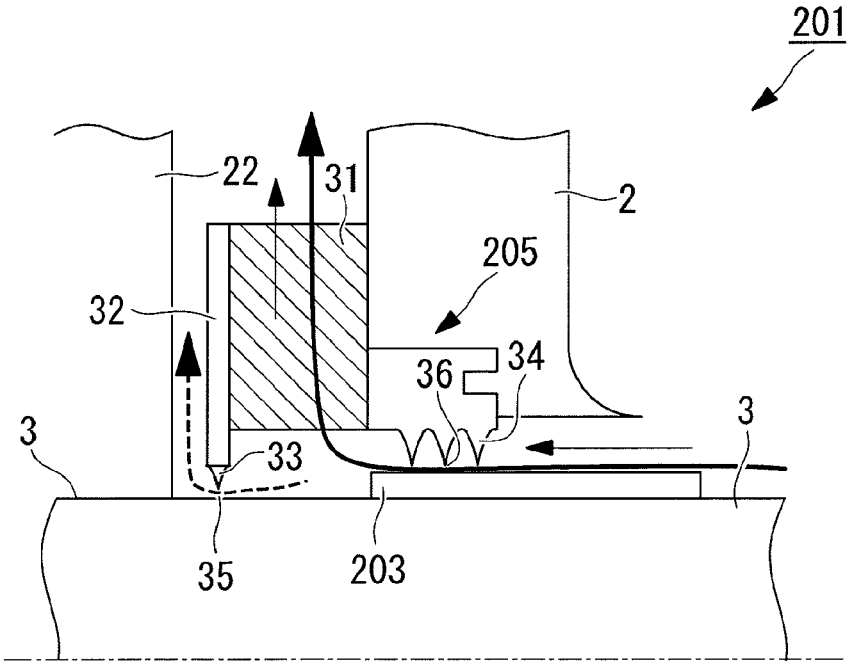
FIG. 7 is a schematic view explaining the structure of a sealing device in a compressor according to a second modification of the first embodiment of the present invention.

FIG. 7 is a schematic view for explaining the structure of the sealing device in the compressor according to this modification.

Note that identical reference numerals are given to the same components as those of the first embodiment, and a description thereof will be omitted.

As shown in FIG. 7, a sealing device 205 of a compressor (rotary fluid machine) 201 includes the plurality of guide plates 31, the partition plate 32, the first seal part 34, the second seal part 33, and a step part (step part) 203.

The step part 203 is a cylindrical member disposed on the outer circumferential surface of the rotary shaft 3 and is disposed at a location facing the first seal part 34.

The thickness of the step part 203, in other words, the thickness from the inner circumferential surface to the outer circumferential surface of the step part 203, is larger than the length of the second gap 35. Further, the distance of the first gap 36 from the rotary shaft 3, that is, the position in the radial direction, is farther than that of the second gap 35. In other words, the first gap 36 is located farther radially outward.

Next, the operation of the sealing device 205, which is a feature of this modification, will be described with reference to FIG. 7. Note that since high-pressure gas is generated in the compressor 201 of this modification in the same way as in the first embodiment, a description thereof will be omitted.

Since a gas flow flows from the rear-stage-side impeller 4 toward the disc 22 through the first gap 36 in the same way as in the first embodiment, a description thereof will be omitted.

The gas flow that has passed through the first gap 36 flows along the axial direction of the rotary shaft 3, and most of the gas flow changes its direction outward in the radial direction to flow in between the guide plates 31.

The rest of the gas flow that has kept on flowing along the axial direction of the rotary shaft 3 is prevented from flowing into the second gap 35 when colliding against the partition plate 32 or the second seal part 33.

Since the subsequent flow of the gas flowing between the guide plates 31 is the same as that in the first embodiment, a description thereof will be omitted.

According to the above-described structure, the step part 203, which radially expands the outer circumferential surface of the rotary shaft 3, is provided at a location facing the first seal part 34, thereby changing the relative position of the first gap 36 and the second gap 35 in the radial direction. Therefore, gas that has passed through the first gap 36 is prevented from directly flowing into the second gap, and the sealing performance of the sealing device 205 can be improved.

SECOND EMBODIMENT

Next, a second embodiment of the present invention will be described with reference to FIGS. 8 to 10.

Although the basic structure of a compressor of this embodiment is the same as that of the first embodiment, the structure of a sealing device is different from that of the first embodiment. Therefore, in this embodiment, only the structure of the sealing device and components surrounding it will be described with reference to FIGS. 8 to 10, and a description of the other components will be omitted.

Figure 8:
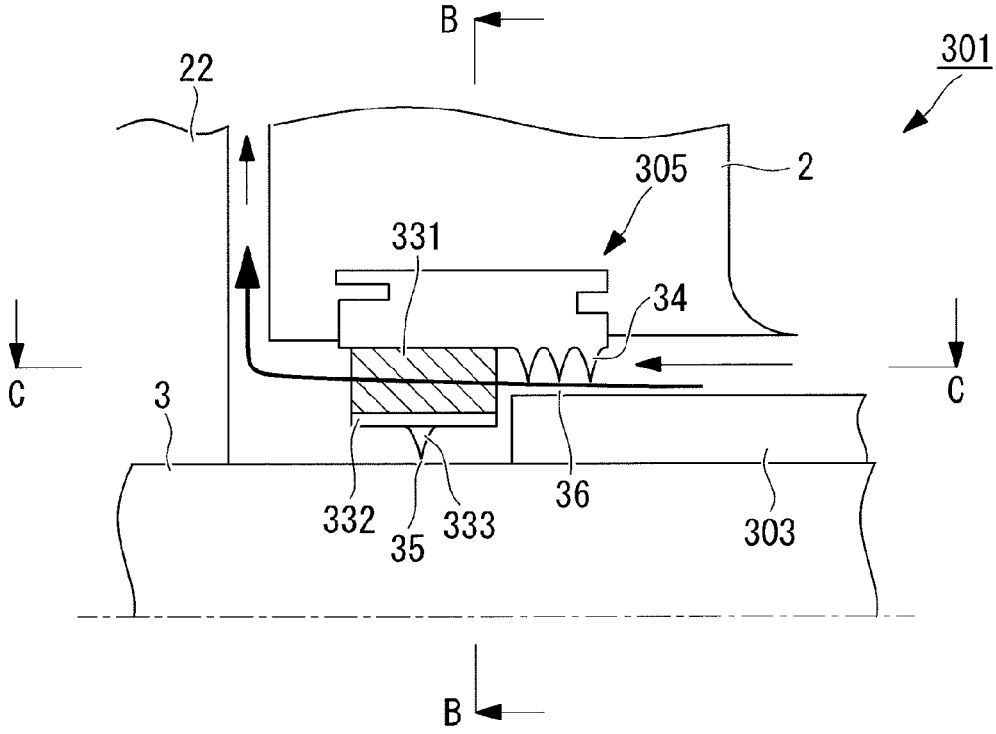
FIG. 8 is a schematic view explaining the structure of a sealing device in a compressor according to a second embodiment of the present invention.

FIG. 8 is a schematic view for explaining the structure of the sealing device in the compressor according to this embodiment.

Note that identical reference numerals are given to the same components as those of the first embodiment, and a description thereof will be omitted.

As shown in FIG. 8, a sealing device 305 of a compressor (rotary fluid machine) 301 includes a plurality of guide plates (guide parts) 331, a partition plate (partition part) 332, a second seal part 333, the first seal part 34, and a step part (step part) 303.

Figure 9:
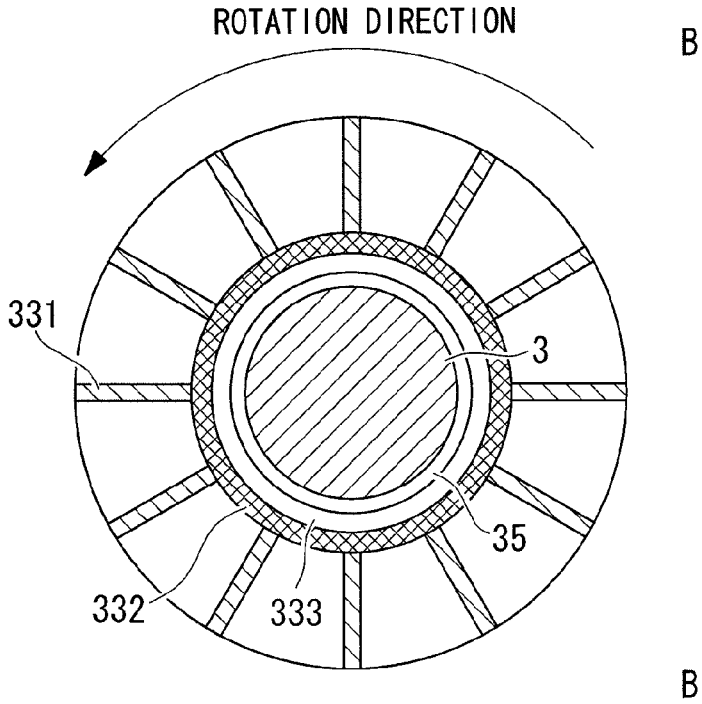
FIG. 9 is a cross-sectional view explaining the structure of guide plates shown in FIG. 8 along the line B-B.

FIG. 9 is a cross-sectional view for explaining the structure of the guide plates shown in FIG. 8 along the line B-B. FIG. 10 is a cross-sectional view for explaining the structure of the guide plates shown in FIG. 8 along the line C-C.

The plurality of guide plates 331 are plate-like members used to impart flow velocity components in the circumferential direction to a leakage flow passing through the sealing device 305.

Figure 10:
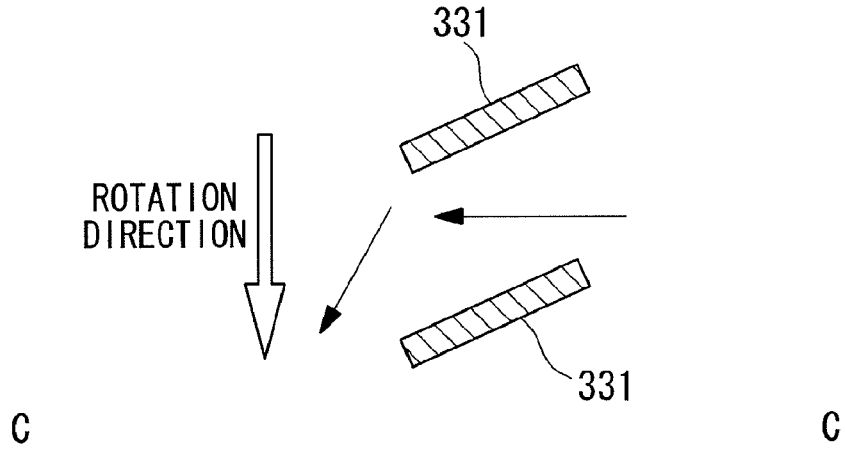
FIG. 10 is a cross-sectional view explaining the structure of the guide plates shown in FIG. 8 along the line C-C.

As shown in FIGS. 8 to 10, on a surface of the housing 2 that faces the rotary shaft 3, the guide plates 331 extend along the axial direction and the radial direction of the rotary shaft 3 and are disposed at equal intervals in the circumferential direction.

The partition plate 332 is a cylindrical member serving as a partition between spaces between the plurality of guide plates 331 and a space between the rotary shaft 3 and the guide plates 331.

The partition plate 332 is a cylindrical member extending in the axial direction of the rotary shaft 3 and is disposed to connect ends of the plurality of guide plates 331 that are close to the rotary shaft 3.

The second seal part 333 blocks the gas flow flowing in between the rotary shaft 3 and the partition plate 332 and guides most of the gas flow flowing between the step part 303 and the housing 2 to the spaces surrounded by the plurality of guide plates 331, the partition plate 332, and the housing 2.

The second seal part 333 is an annular protrusion extending from the center portion on the inner circumferential surface of the partition plate 332 toward the rotary shaft 3, in other words, extending inward in the radial direction, forming the second gap 35 with respect to the rotary shaft 3.

The step part 303 is a cylindrical member disposed on the outer circumferential surface of the rotary shaft 3 and is disposed at a location facing the first seal part 34.

In the step part 303, the thickness of the step part 303, that is, the thickness from the inner circumferential surface to the outer circumferential surface of the step part 303, is larger than the second gap 35, and, more preferably, it is formed with a thickness up to approximately the center positions of the guide plates 331 in the radial direction. Further, the distance of the first gap 36 from the rotary shaft 3, that is, the position in the radial direction, is farther than that of the second gap 35. In other words, the first gap 36 is located farther radially outward.

Next, the operation of the sealing device 305, which is a feature of this embodiment, will be described with reference to FIGS. 8 to 10. Note that since high-pressure gas is generated in the compressor 301 of this modification in the same way as in the first embodiment, a description thereof will be omitted.

Since a gas flow flows from the rear-stage-side impeller 4 toward the disc 22 through the first gap 36 in the same way as in the first embodiment, a description thereof will be omitted.

As shown in FIGS. 8 and 9, the gas flow that has passed through the first gap 36 flows along the outer circumferential surface of the step part 303, and most of the gas flow directly flows into the spaces between the guide plates 331, the housing 2, and the partition plate 332.

As shown in FIG. 10, the guide plates 331 extend inclining in the rotation direction of the rotary shaft 3 toward the disc 22 (leftward in FIG. 10). Therefore, flow velocity components in the rotation direction of the rotary shaft 3 are imparted to the gas flow flowing out from between the guide plates 331.

As shown in FIG. 9, the second seal part 333 is disposed between the rotary shaft 3 and the partition plate 332, and a throttle is formed there of the second gap 35 formed by the second seal part 333 and the rotary shaft 3. Further, the region between a flow passage between the housing 2 and the step part 303 and a flow passage between the rotary shaft 3 and the partition plate 332 is bent in the form of a crank.

Therefore, since the flow passage resistance with respect to a gas flow passing through the second gap 35 is higher than the flow passage resistance with respect to a gas flow flowing between the guide plates 331, most of the gas flow flows into flow passages formed between the guide plates 331.

Further, since the partition plate 332 is provided on the ends of the guide plates 331 that are close to the rotary shaft 3, the gas flow neither flows from between the guide plates 331 to between the rotary shaft 3 and the partition plate 332 nor flows in reverse from between the rotary shaft 3 and the partition plate 332 to between the guide plates 331.

The gas flow flowing out from between the guide plates 331 flows between the outer circumferential surface of the rotary shaft 3 and the housing 2 toward the disc 22 and flows into a gap between the disc 22 and the impeller chamber 13.

Since the subsequent gas flow is the same as that in the first embodiment, a description thereof will be omitted.

According to the above-described structure, the gas flow flowing through the spaces between the plurality of guide plates 331 is directed from the first seal part 34 toward the plurality of guide plates 331 along the axial direction, thereby making it possible to reduce the length of the sealing device 305 along the radial direction.

The step part 303, which radially expands the outer circumferential surface of the rotary shaft 3, is provided at a location facing the first seal part 34, thereby changing the relative position of the first gap 36 and the second gap 35 in the radial direction. Therefore, gas that has passed through the first gap 36 is prevented from directly flowing into the second gap 35, and the sealing performance of the sealing device 305 can be improved.

The guide plates 331 are formed in a plate-like shape, which is simpler than the shape of blade-like guide plates, for example, and therefore the sealing device 305 is easily manufactured.

First Modification of Second Embodiment

Next, a first modification of the second embodiment of the present invention will be described with reference to FIGS. 11 to 13.

Although the basic structure of a compressor of this modification is the same as that of the second embodiment, the structure of a sealing device is different from that of the second embodiment. Therefore, in this modification, only the structure of the sealing device and components surrounding it will be described with reference to FIGS. 11 to 13, and a description of the other components will be omitted.

Figure 11:
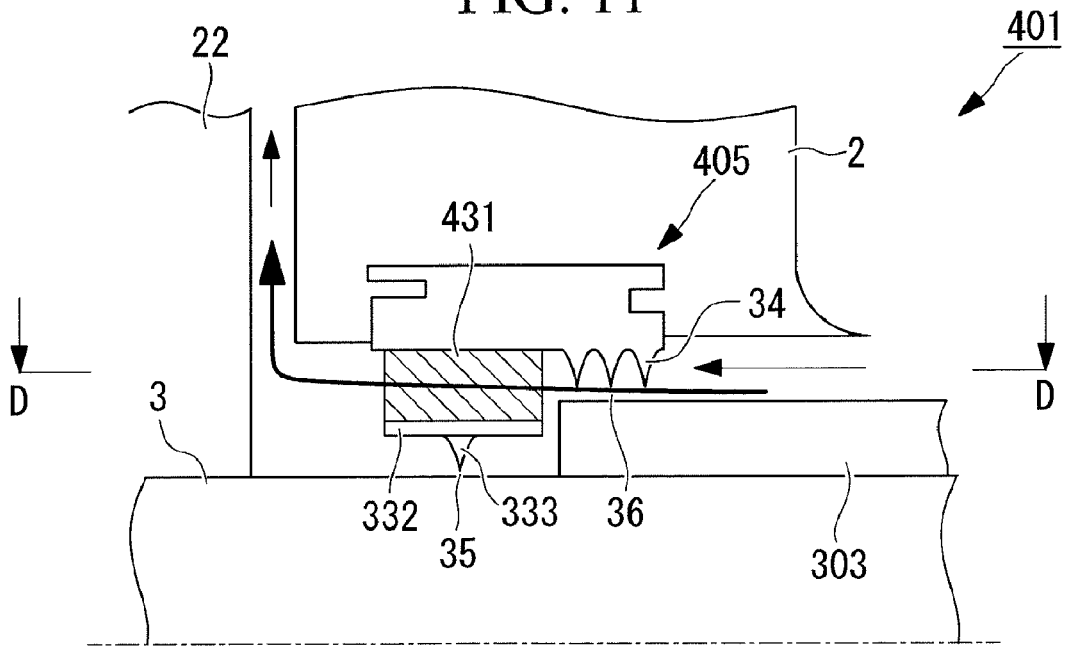
FIG. 11 is a schematic view explaining the structure of a sealing device in a compressor according to a first modification of the second embodiment of the present invention.

FIG. 11 is a schematic view for explaining the structure of the sealing device in the compressor according to this modification. FIG. 12 is a cross-sectional view for explaining the structure of the sealing device shown in FIG. 11 along the line D-D.

Note that identical reference numerals are given to the same components as those of the second embodiment, and a description thereof will be omitted.

As shown in FIG. 11, a sealing device 405 of a compressor (rotary fluid machine) 401 includes a plurality of guide plates (guide parts) 431, the partition plate 332, the first seal part 34, the second seal part 333, and the step part 303.

The plurality of guide plates 431 are blade-like members used to impart flow velocity components in the circumferential direction to a leakage flow passing through the sealing device 405.

Figure 12:
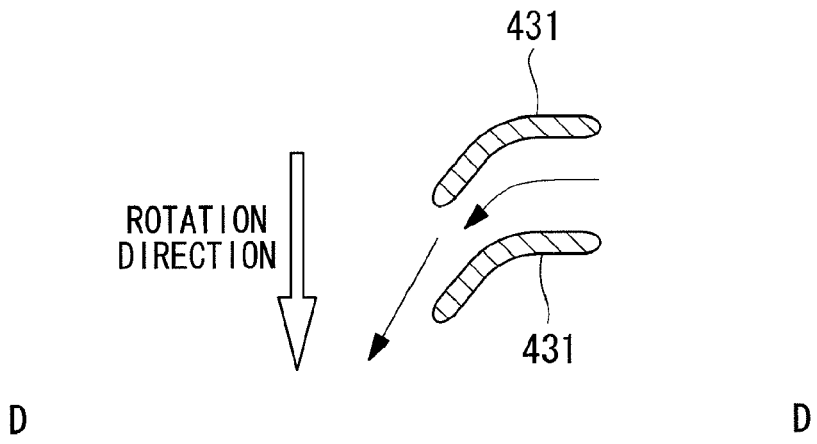
FIG. 12 is a cross-sectional view explaining the structure of the sealing device shown in FIG. 11 along the line D-D.

As shown in FIGS. 11 and 12, on a surface of the housing 2 facing the rotary shaft 3, the guide plates 431 extend along the radial direction of the rotary shaft 3 and are disposed at equal intervals in the circumferential direction. Further, toward the disc 22 in the axial direction, the guide plates 431 are disposed so as to be curved in the rotation direction of the rotary shaft 3.

Next, the operation of the sealing device 405, which is a feature of this modification, will be described with reference to FIGS. 11 and 12. Note that since high-pressure gas is generated in the compressor 401 of this modification in the same way as in the first embodiment, a description thereof will be omitted.

Since a gas flow flows from the rear-stage-side impeller 4 toward the disc 22 through the first gap 36 in the same way as in the first embodiment, a description thereof will be omitted.

As shown in FIGS. 11 and 12, the gas flow that has passed through the first gap 36 flows along the outer circumferential surface of the step part 303, and most of the gas flow directly flows into the spaces between the guide plates 431, the housing 2, and the partition plate 332.

As shown in FIGS. 11 and 12, since gas inflow sides of the guide plates 431 extend along the axial direction of the rotary shaft 3, the gas flow flowing along the axial direction of the rotary shaft 3 is hardly separated from the guide plates 331.

On the other hand, outflow sides of the guide plates 431 extend so as to be curved in the rotation direction of the rotary shaft 3 toward the disc 22 (leftward in FIG. 12). Therefore, flow velocity components in the rotation direction of the rotary shaft 3 are imparted to the gas flow flowing out from between the guide plates 431.

Since the subsequent gas flow is the same as that in the second embodiment, a description thereof will be omitted.

According to the above-described structure, the guide plates 431 are formed in a blade-like shape and are curved in the rotation direction of the rotary shaft 3, thereby making it possible to reduce loss that occurs when the flow velocity components in the circumferential direction are imparted to the gas flow, compared with plate-like guide plates.

Figure 13:
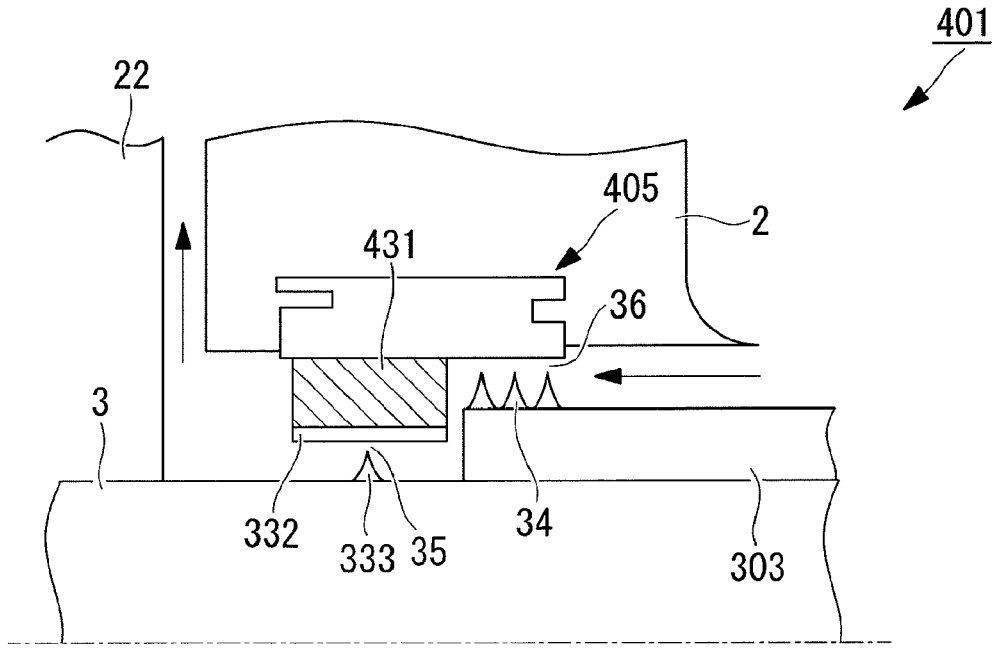
FIG. 13 is a schematic view explaining the sealing device shown in FIG. 11 according to another embodiment.

FIG. 13 is a schematic view for explaining the sealing device shown in FIG. 11 according to another embodiment.

Note that, as in the above-described embodiment, the first seal part 34 and the second seal part 333 may be annular protrusions extending inward in the radial direction to form the first gap 36 with respect to the step part 303 and to form the second gap 35 with respect to the rotary shaft 3, or, as shown in FIG. 13, the first seal part 34 and the second seal part 333 may be annular protrusions extending outward in the radial direction to form the first gap 36 between the first seal part 34 and the housing 2 and to form the second gap 35 between the second seal part 333 and the partition plate 332; their structures are not particularly limited.

Second Modification of Second Embodiment

Next, a second modification of the second embodiment of the present invention will be described with reference to FIGS. 14 and 15.

Although the basic structure of a compressor of this modification is the same as that of the second embodiment, the structure of a sealing device is different from that of the second embodiment. Therefore, in this modification, only the structure of the sealing device and components surrounding it will be described with reference to FIGS. 14 and 15, and a description of the other components will be omitted.

Figure 14:
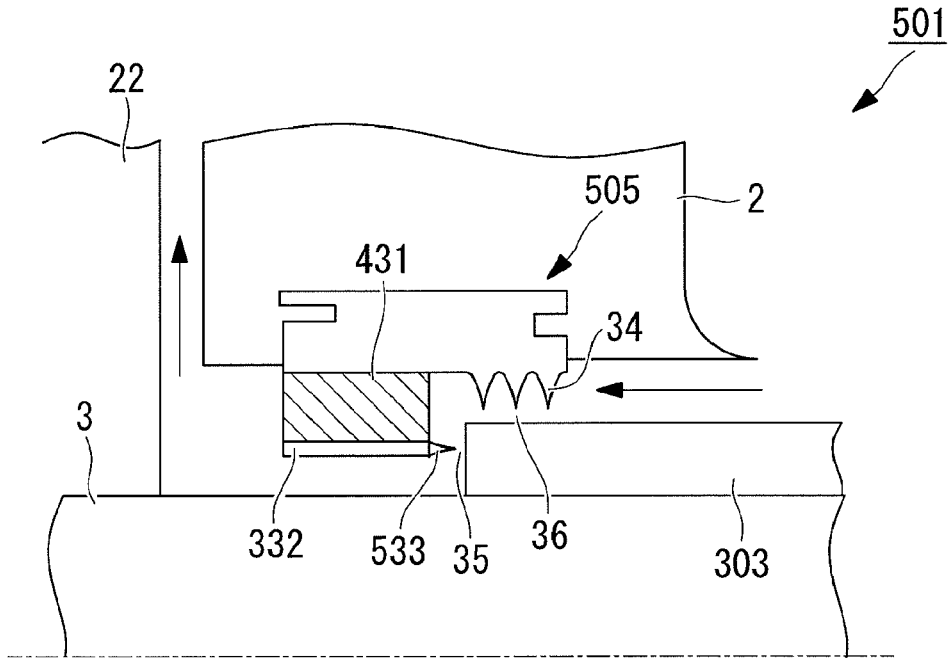
FIG. 14 is a schematic view explaining the structure of a sealing device in a compressor according to a second modification of the second embodiment of the present invention.

FIG. 14 is a schematic view for explaining the structure of the sealing device in the compressor according to this modification.

Note that identical reference numerals are given to the same components as those of the second embodiment, and a description thereof will be omitted.

As shown in FIG. 14, a sealing device 505 of a compressor (rotary fluid machine) 501 includes the plurality of guide plates 431, the partition plate 332, the first seal part 34, a second seal part 533, and the step part 303.

The second seal part 533 blocks a gas flow flowing in between the rotary shaft 3 and the partition plate 332 and guides most of a gas flow flowing between the step part 303 and the housing 2 to the spaces surrounded by the plurality of guide plates 431, the partition plate 332, and the housing 2.

As shown in FIG. 14, the second seal part 533 is an annular protrusion extending along the axis of the rotary shaft 3 toward a step face of the step part 303, forming the second gap 35 with respect to the step part 303.

Next, the operation of the sealing device 505, which is a feature of this modification, will be described with reference to FIG. 14. Note that since high-pressure gas is generated in the compressor 501 of this modification in the same way as in the first embodiment, a description thereof will be omitted.

Since a gas flow flows from the rear-stage-side impeller 4 toward the disc 22 through the first gap 36 in the same way as in the first embodiment, a description thereof will be omitted.

As shown in FIG. 14, the gas flow that has passed through the first gap 36 flows along the outer circumferential surface of the step part 303, and most of the gas flow directly flows into the spaces between the guide plates 431, the housing 2, and the partition plate 332.

The guide plates 431 extend inclining in the rotation direction of the rotary shaft 3 toward the disc 22. Therefore, flow velocity components in the rotation direction of the rotary shaft 3 are imparted to the gas flow flowing out from between the guide plates 431.

As shown in FIG. 14, the second seal part 533 is disposed between the step part 303 and the partition plate 332, and a throttle is formed there of the second gap 35 formed by the second seal part 533 and the step part 303. Further, the region between a flow passage between the housing 2 and the step part 303 and a flow passage between the rotary shaft 3 and the partition plate 332 is bent in the form of a crank.

Therefore, since the flow passage resistance with respect to a gas flow passing through the second gap 35 is higher than the flow passage resistance with respect to a gas flow passing through between the guide plates 431, most of the gas flow flows into flow passages formed between the guide plates 331.

Since the subsequent gas flow is the same as that in the second embodiment, a description thereof will be omitted.

According to the above-described structure, the second seal part 533 is an annular protrusion extending along the axis of the rotary shaft 3 toward the step face of the step part 303. Therefore, gas that has passed thought the first gap 36 is prevented from directly flowing into the second gap 35, and the sealing performance of the sealing device 505 can be improved.

Figure 15:
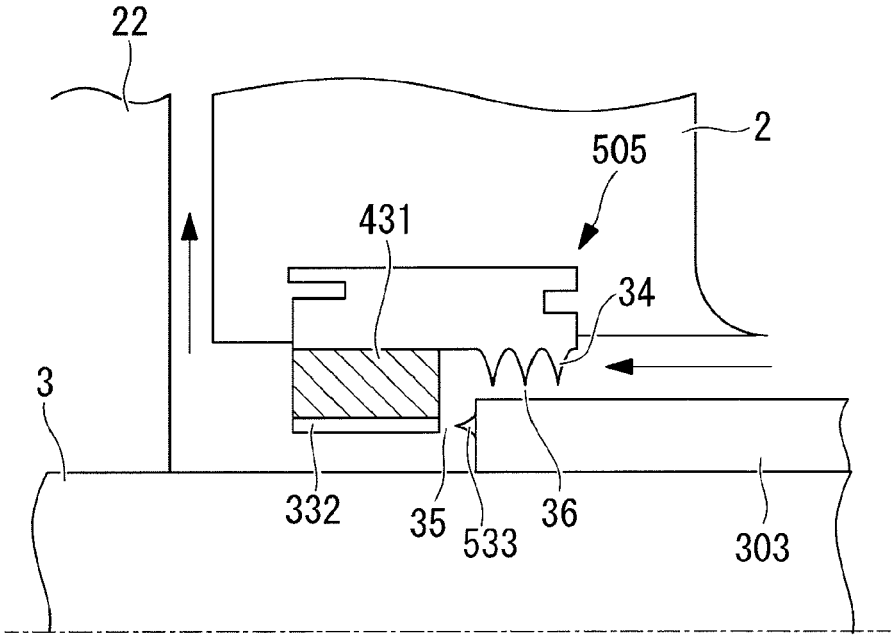
FIG. 15 is a schematic view explaining the sealing device shown in FIG. 14 according to another embodiment.

FIG. 15 is a schematic view for explaining the sealing device shown in FIG. 14 according to another embodiment.

Note that, as in the above-described modification, the second seal part 533 may be an annular protrusion extending along the axial direction toward the step face of the step part 303, or, as shown in FIG. 15, the second seal part 533 may be an annular protrusion extending along the axial direction toward the partition plate 332 to form the second gap 35 between the second seal part 533 and the partition plate 32; the structure thereof is not particularly limited.

Note that the technical scope of the present invention is not limited to the above-described embodiments, and various modifications can be made without departing from the gist of the present invention.

For example, in the above-described embodiments, the present invention is applied to a centrifugal compressor. However, the present invention is not limited to application to a centrifugal compressor and may be applied to a mixed flow compressor; machines to which the present invention is applied are not particularly limited.

The invention claimed is:

1. A sealing device for a rotary fluid machine, comprising:

a housing having an inner surface, and being configured to rotatably accommodate a rotary shaft having a plurality of impellers;

a plurality of guide parts mounted on said inner surface of said housing, between said plurality of impellers, said plurality of guide parts extending along at least one of a radial direction and an axial direction of the rotary shaft, and being configured to impart flow velocity components in the rotation direction of the rotary shaft to fluid passing through therebetween, said plurality of guide parts having first ends and second ends, said second ends being opposite said first ends;

a partition part connecting said first ends of said plurality of guide parts, said second ends of said plurality of guide parts being mounted on said housing, and said partition plate being a partition between spaces between said plurality of guide parts and an outside space;

a first seal part that is an annular protrusion extending in the radial direction, and being configured to form a first gap with respect to the rotary shaft or said housing, and being configured to block fluid flowing toward said plurality of guide parts;

a second seal part that is an annular protrusion, and being configured to form a second gap with respect to the rotary shaft or said partition part, and being configured to block fluid flowing through the outside space; and wherein the sealing device for a rotary fluid machine is configured to permit the fluid to pass outward in the radial direction through the spaces between said plurality of guide parts.

2. A sealing device for a rotary fluid machine, according to claim 1, wherein:

said first ends of said plurality of guide parts are configured and arranged to face one of the impellers extending from the rotary shaft outward in the radial direction; and the partition part extends in the radial direction and is formed in a ring-plate shape to connect said first ends.

3. A sealing device for a rotary fluid machine, according to claim 2, wherein:

said second seal part extends in the radial direction; and said first seal part or said second seal part is configured and arranged so as to face a step part radially expanding the outer circumferential surface of the rotary shaft.

4. A sealing device for a rotary fluid machine, according to claim 1, wherein:

said first ends of the plurality of guide parts are configured and arranged to face an outer circumferential surface of the rotary shaft; and said partition part extends in the axial direction, is formed in a cylindrical shape to connect said first ends, and is configured to cause the fluid to pass along the axial direction through the spaces between said plurality of guide parts.

5. A sealing device for a rotary fluid machine, according to claim 4, wherein:

said second seal part extends in the radial direction; and said first seal part or said second seal part is configured and arranged so as to face a step part radially expanding the outer circumferential surface of the rotary shaft.

6. A sealing device for a rotary fluid machine, according to claim 1, wherein said guide parts are plate members inclining in the rotation direction of the rotary shaft outward in the radial direction, or are plate members inclining in the rotation direction of the rotary shaft from said first seal part toward said second seal part along the axial direction.

7. A sealing device for a rotary fluid machine, according to claim 1, wherein said guide parts are blade members extending along the radial direction or the axial direction and are curved in the rotation direction of the rotary shaft outward in the radial direction, or are curved in the rotation direction of the rotary shaft from said first seal part toward said second seal part along the axial direction.

8. A rotary fluid machine comprising a sealing device according to claim 1.

* * * * *